United States Patent [19]

Faber et al.

[11] 4,104,128

[45] Aug. 1, 1978

[54] APPARATUS AND METHOD FOR RECOVERY OF COAL FINES

[75] Inventors: Paul V. Faber, Morristown; Edwin R. Daly, Morris Plains; Prithvi Jain, Parsippany, all of N.J.

[73] Assignee: Wilputte Corporation, New Providence, N.J.

[21] Appl. No.: 707,699

[22] Filed: Jul. 21, 1976

[51] Int. Cl.[2] ..... B03B 9/00; C10B 53/04

[52] U.S. Cl. ..... 201/4; 201/23; 201/28; 201/36; 201/41; 201/42; 202/82; 209/2; 210/67; 210/195 S; 210/196; 210/259

[58] Field of Search ..... 201/4, 21, 23, 28, 29, 201/31, 36, 38, 40, 41, 42; 202/81, 82, 84, 96; 210/67, 195 S, 196, 259; 209/2 US, 12, 17

[56] References Cited

U.S. PATENT DOCUMENTS

| | | | |
|---|---|---|---|
| 1,971,834 | 8/1934 | Ramsburg | 208/100 |
| 2,610,944 | 9/1952 | Hemminger | 201/4 |
| 2,956,944 | 10/1960 | Logan et al. | 210/67 X |
| 3,047,473 | 7/1962 | Schmidt | 201/4 |
| 3,432,398 | 3/1969 | Schmidt | 201/38 |
| 3,696,923 | 10/1972 | Miller | 209/12 |
| 3,962,043 | 6/1976 | Schmalfeld et al. | 201/21 |
| 3,992,266 | 11/1976 | Aktay et al. | 201/23 X |

*Primary Examiner*—Joseph Scovronek
*Attorney, Agent, or Firm*—Buell, Blenko & Ziesenheim

[57] ABSTRACT

The specification discloses apparatus and methods for recovery of coal fines and for recycling thereof incidental to a self-contained system for charging preheated coal into coke ovens. The apparatus enables a system for charging preheated coal into coke ovens to meet pollution control regulations. The apparatus comprises four circulating streams of liquid for carrying coal fines in a slurry, namely, the charge main liquor circuit, the excess recycle gas scrubber circuit, the charge line condenser circuit and the charge bin vent condenser circuit. The −28 mesh coal with the liquor from the various circuits goes to a clarifier or thickener. Floating fines from top and settled fines from the bottom of the thickener are pumped via a fines tank to filters from which the solid or coagulated fines are restored to the wet coal feed to the heaters. Tars developed in the recovery processes are utilized instead of adding oil to liquors in process, for various reasons, including facilitating flow of coal through the pipe lines of oven charging systems.

32 Claims, 8 Drawing Figures

Figure 1A:
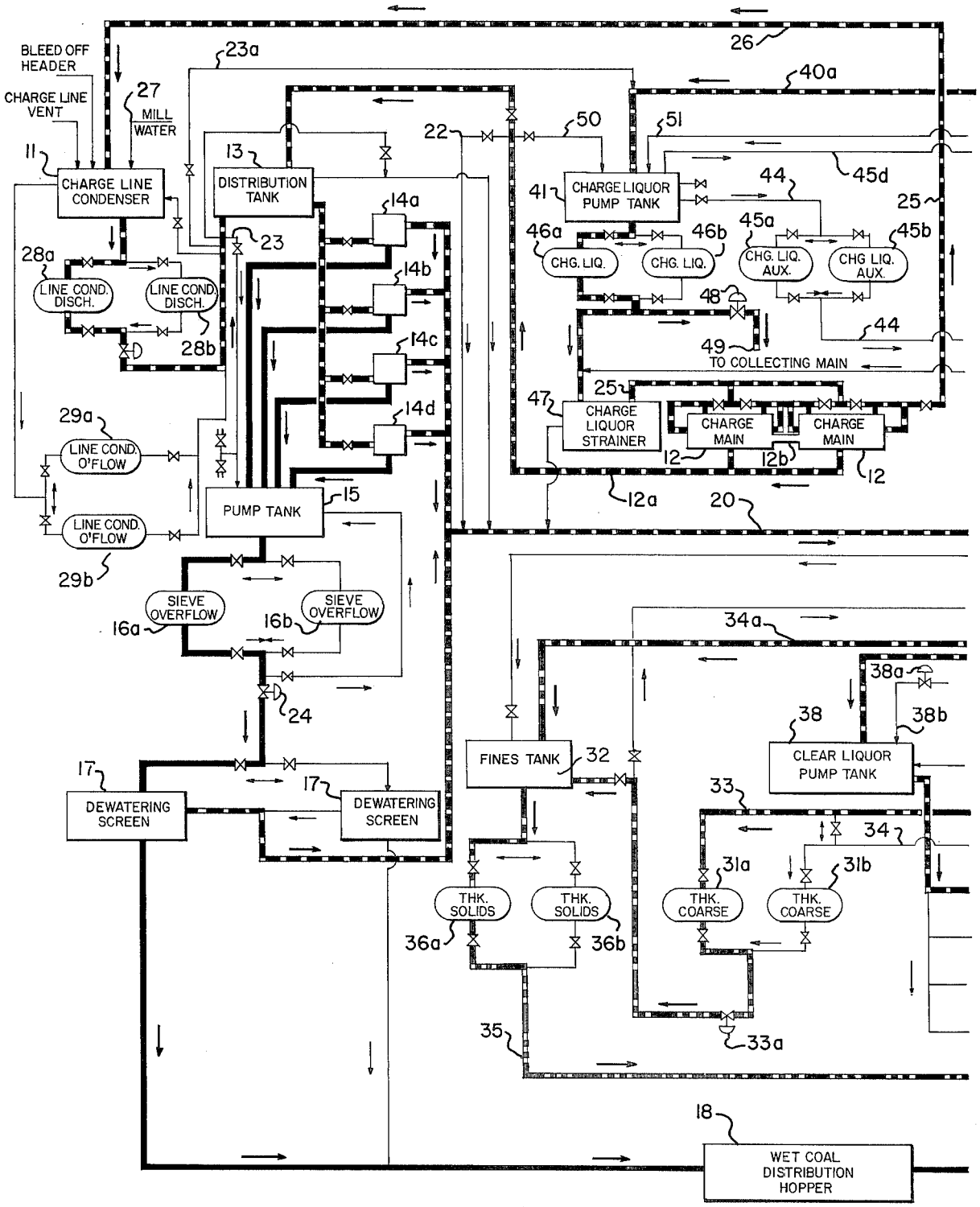

Fig. IB.
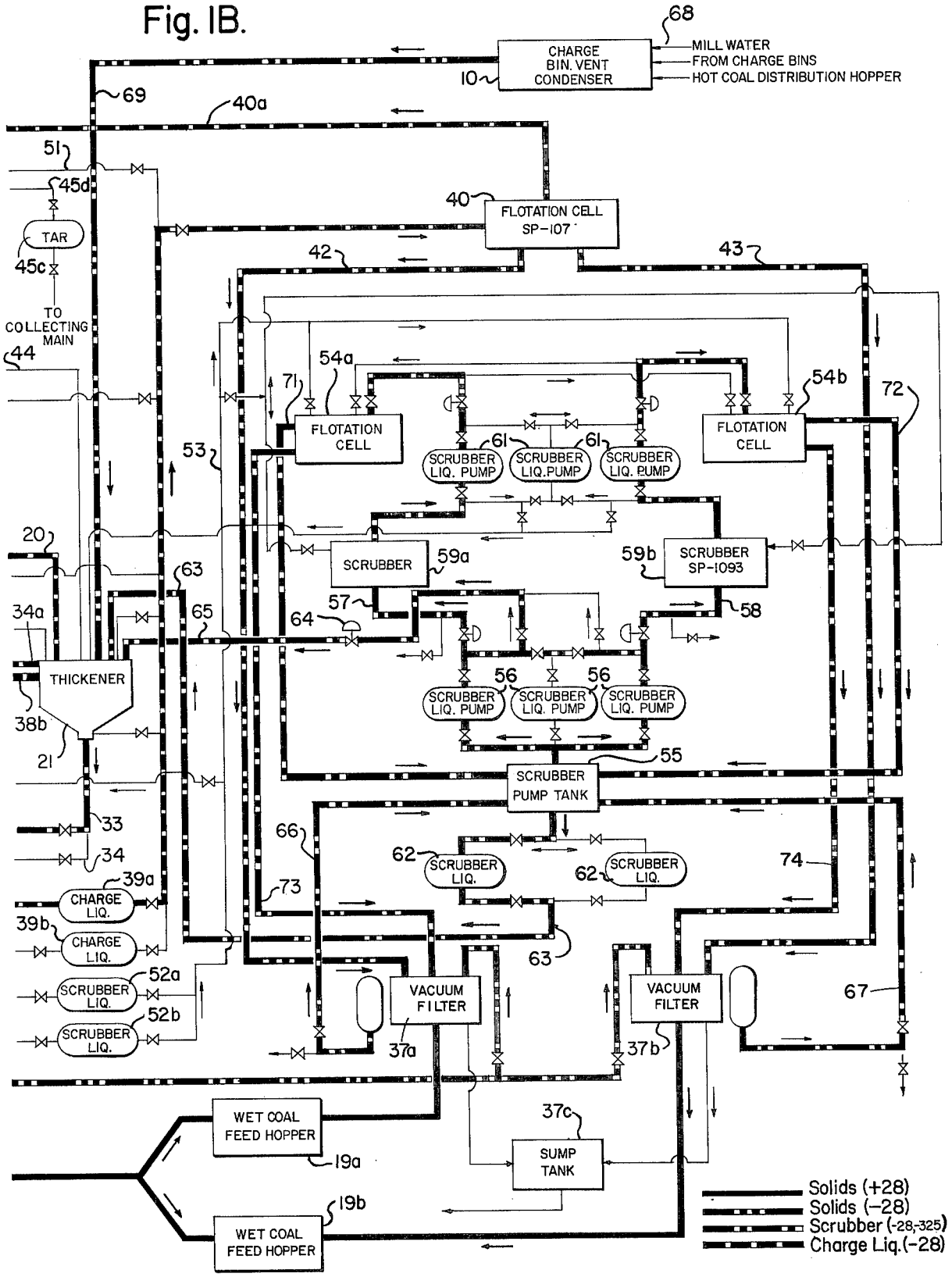

APPARATUS AND METHOD FOR RECOVERY OF COAL FINES

This invention relates to apparatus associated with coke oven charging systems and particularly to apparatus employed in connection therewith for recovering coal fines or other particulate emissions incidental to such charging systems and for recycling the fines and particulates into the charging system and to prevent emissions of noxious vapors or solids into the atmosphere.

Heretofore known systems for recovery of fine coal particles emitted from heated coal being charged into coke ovens are not effective in preventing atmosphere pollution.

It is the purpose of this invention to provide a coal fines recovery system capable of processing the effluent from a coal preheating and charging system. Such a system may comprise two heaters, each operating at 80 tons per hour of wet coal to provide the coal required for charging a 98 coke oven battery.

It is a further purpose of this invention to provide, in association with preheated coal coke oven charging systems, apparatus for recovery and recycling of coal fines into the coal heating portion of the coke oven charging system, which apparatus comprises a charge main liquor loop or circuit including a charge main to which fines are emitted directly during coke oven charging and also via a charging line condenser from bleed-off steam and coal transport lines, an excess recycle gas scrubber loop or circuit, a charge line condenser loop or circuit and a charging bin vent condenser loop or circuit. The coal fines recovery system described can be used with any of the systems for charging preheated coal into coke ovens. One such coke oven charging system of the type in which heated coal is conducted in a fluidized state for charging the coke ovens is disclosed in the U.S. Pat. Nos. 3,047,473 and 3,537,755 of L. D. Schmidt.

In carrying out the above objectives, we further provide a so-called clarifier or thickener into which the fines recovered in the above-mentioned circuit loops are fed and from which the coagulated fines or solids are removed and from which clarified liquor is resupplied to those loops or circuits.

More particularly we also provide various combinations with the thickener of gas scrubbers, flotation cells and filters whence solids or coagulated fines are returned to the wet coal feed and then to the coal heating phase of the coal charging operation. In the operation of systems for coke-oven charging it is usual at some point to supply oil into the fluidized coal being transported through pipe lines to the coke ovens in order to facilitate flow of coal through the pipe lines. We have found that in the apparatus and method for recovery of coal fines which we provide, there is no need for addition of oil at any point for the purpose of facilitating flow of coal through pipe lines for reducing carryover and for increasing coal bulk density, because of the fact that coal fines forming part of the liquor circulating in the charge main circuit absorb some of the tars generated during the oven charging process and are recycled into the recovery process. We have discovered that the tars thus added to the recycled coal fines serves the same purpose as oil in respect of facilitating flow of coal through the pipe lines for reducing fine coal carryover and increasing coal bulk density. Our system for recovery of coal fines thus eliminates the need and the consequent expenditure for oil in the operation of the system. For an eighty ton per hour preheater, the savings in oil is equivalent to 120 gallons of oil per hour.

We have further found that in our coal fines recovery system, the charge liquor pump circuit must be kept operative under standby conditions of the coal charging apparatus. If the standby condition endures for more than 24 hours, the charge liquor may show evidence of containing liquid tars distilled from the coal. We, therefore, provide a discharge line and a pump for removing such liquid tars as may accumulate in the charge liquor pump tank through said discharge line.

A preferred form of our invention is more fully described hereinafter in connection with the accompanying drawings, wherein:

FIGS. 1A and 1B, taken together in side-by-side relation, are a diagrammatic view of the apparatus constituting our coal fines recovery and recycling system for association with a coke-oven charging system, with coded lines representing the flow path for effluents containing coal fines of different mesh consistency.

Figure 2:
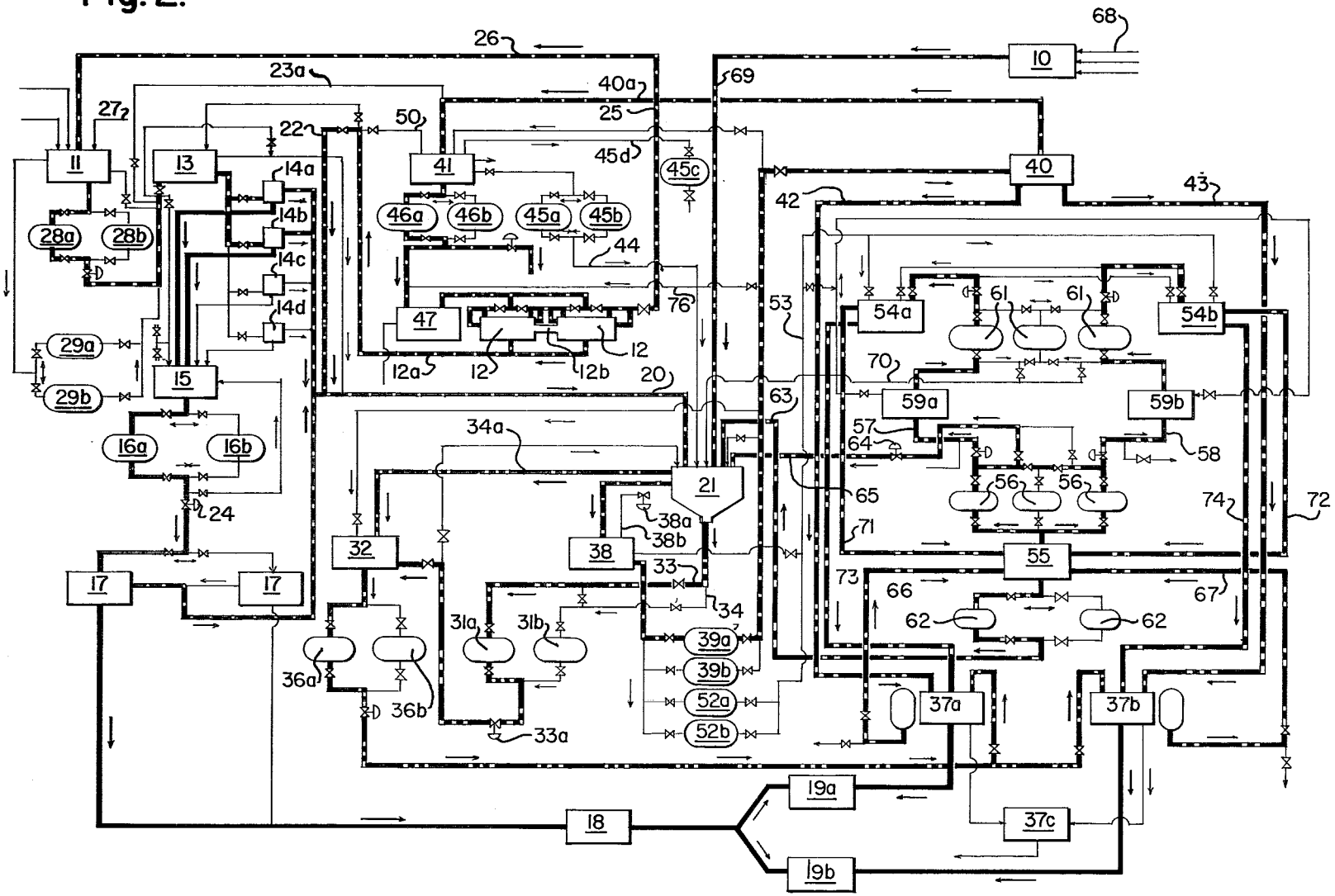
Figure 3:
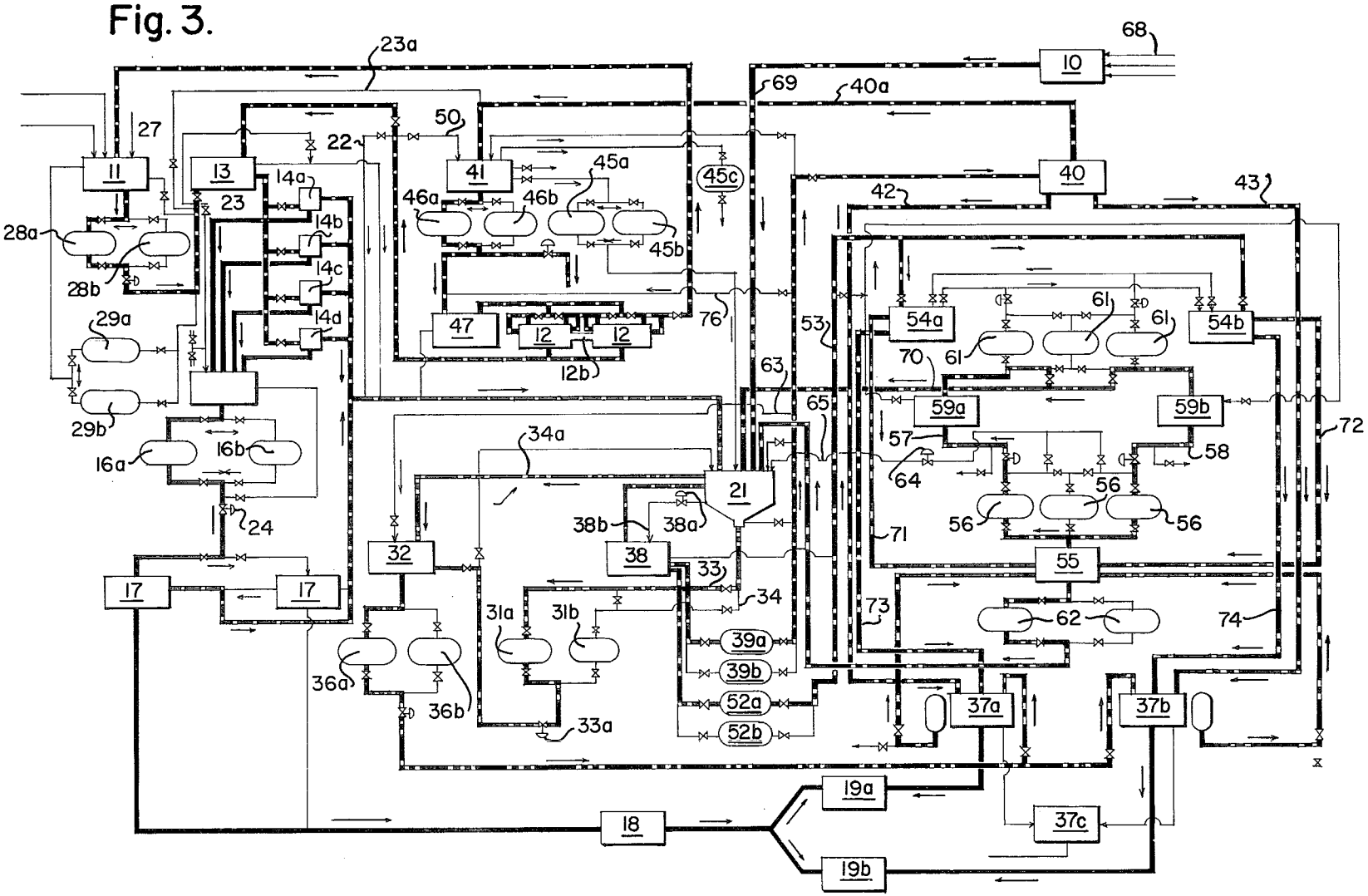
Figure 4:
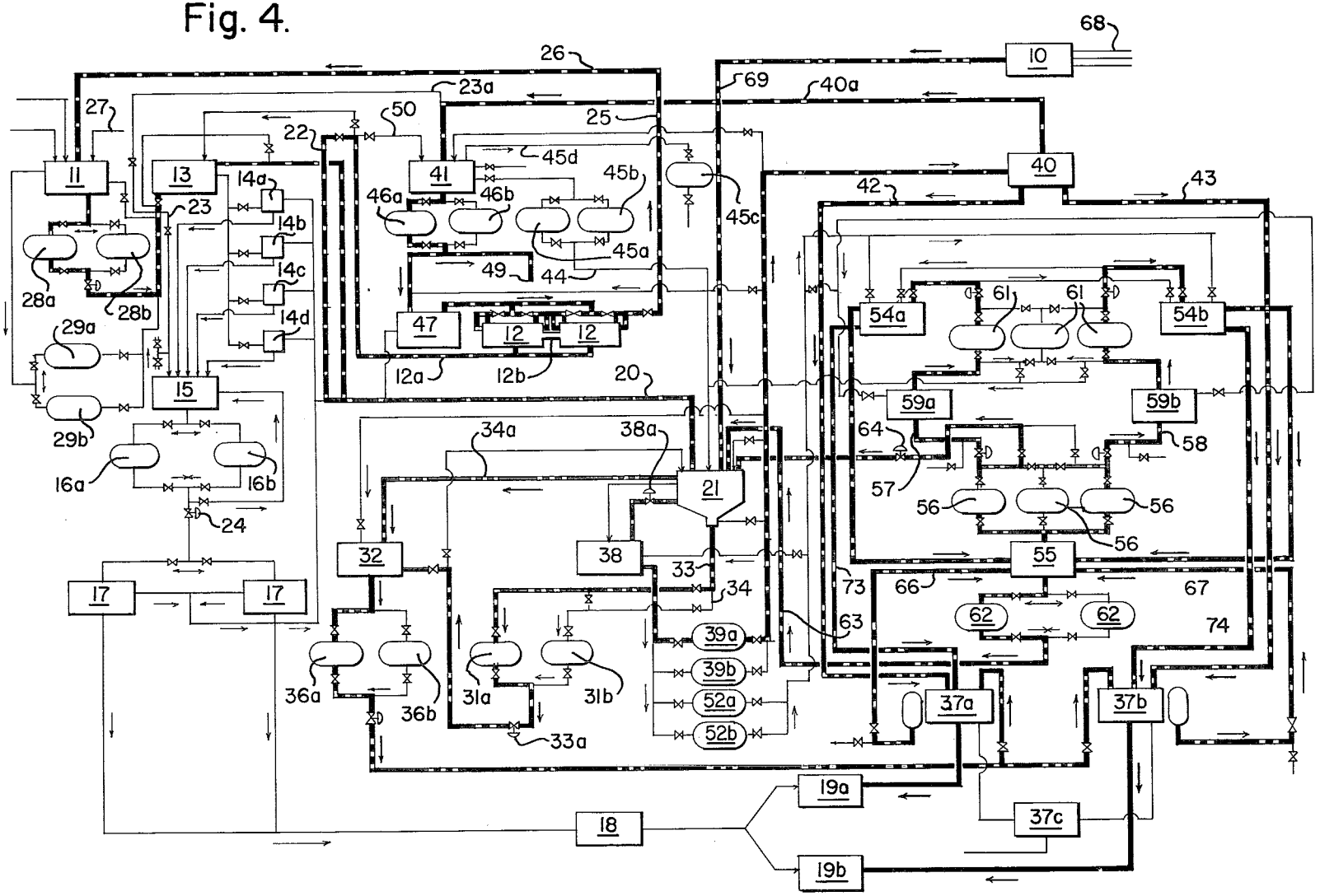
Figure 5:
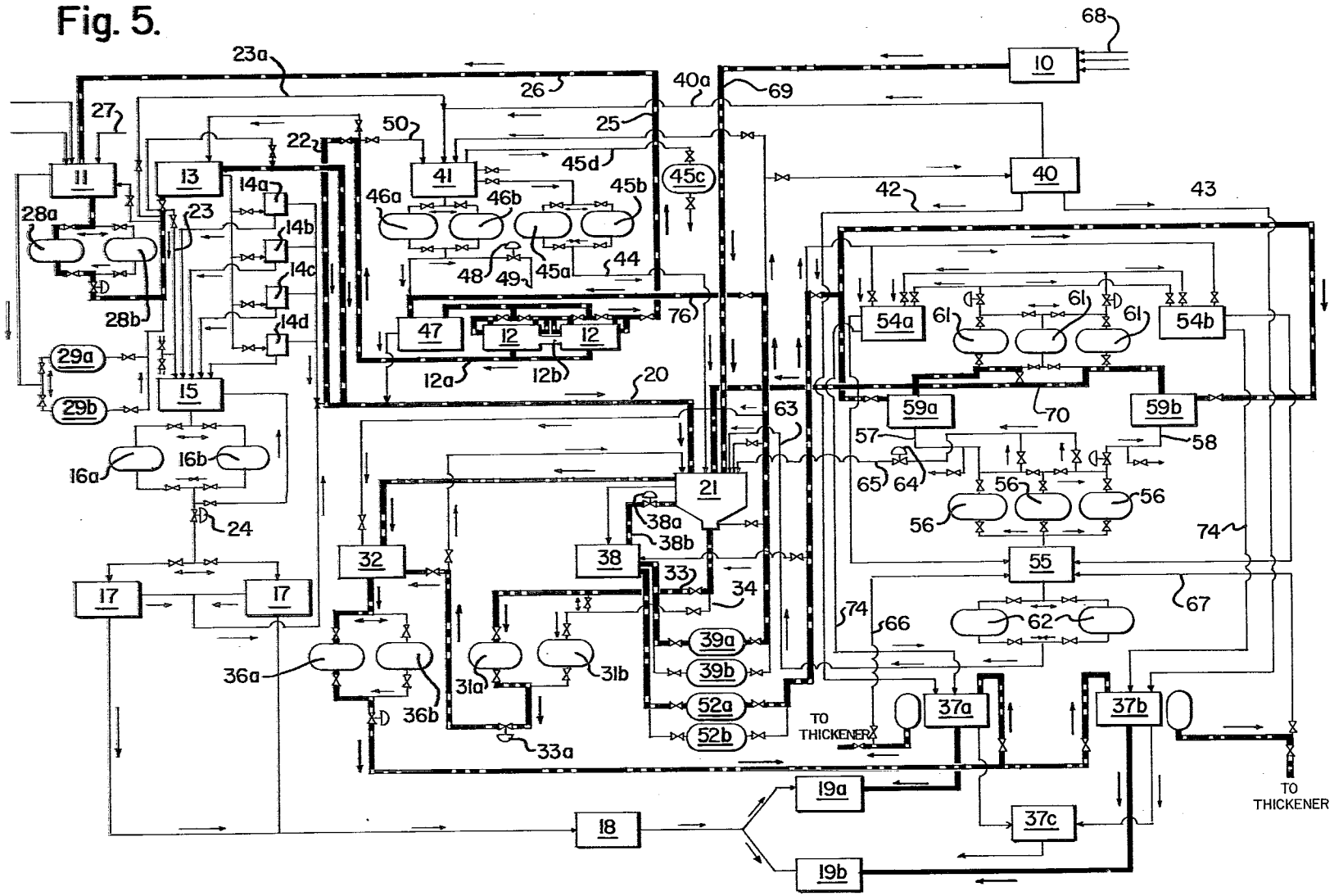
Figure 6:
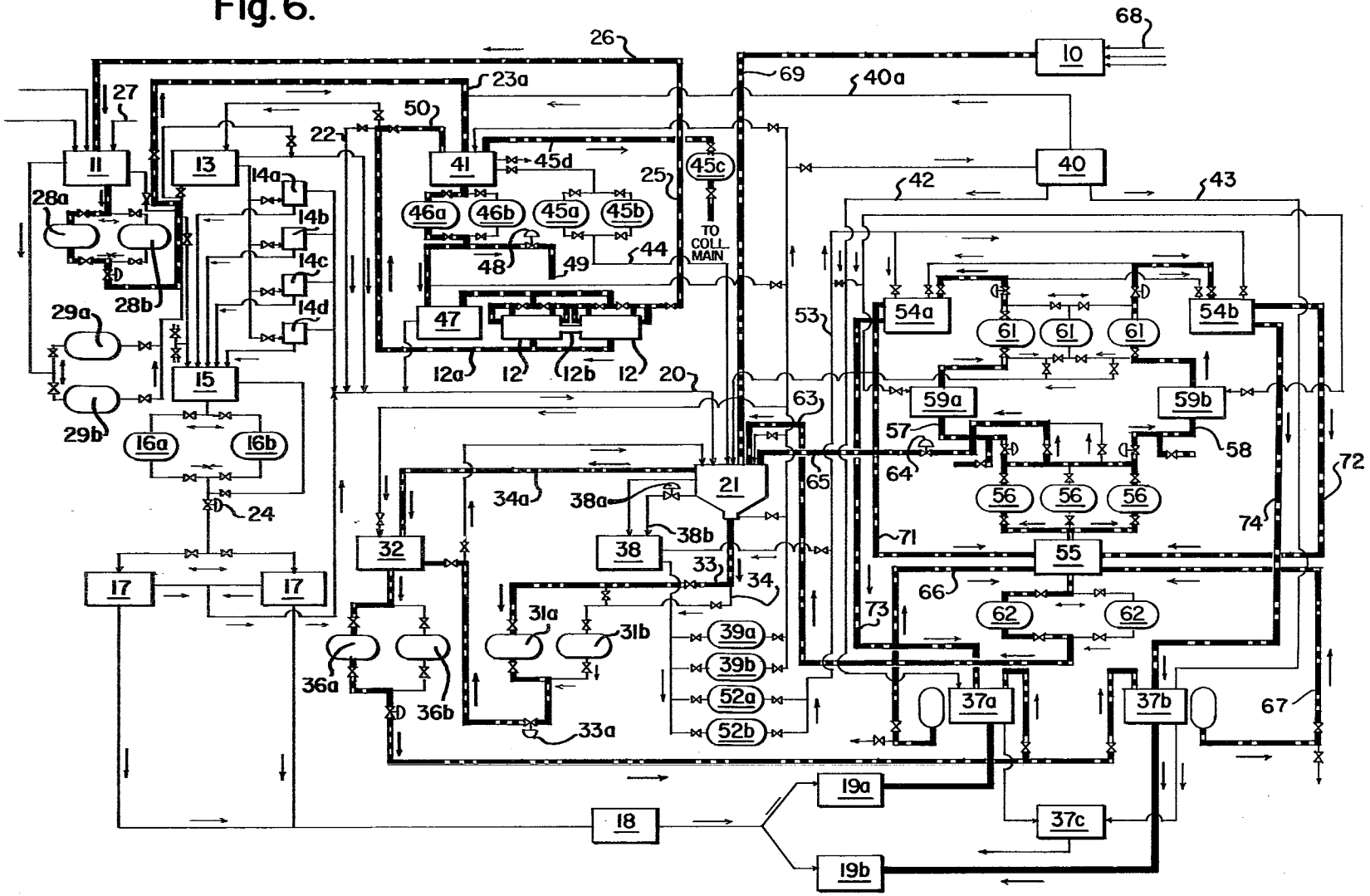
Figure 7:
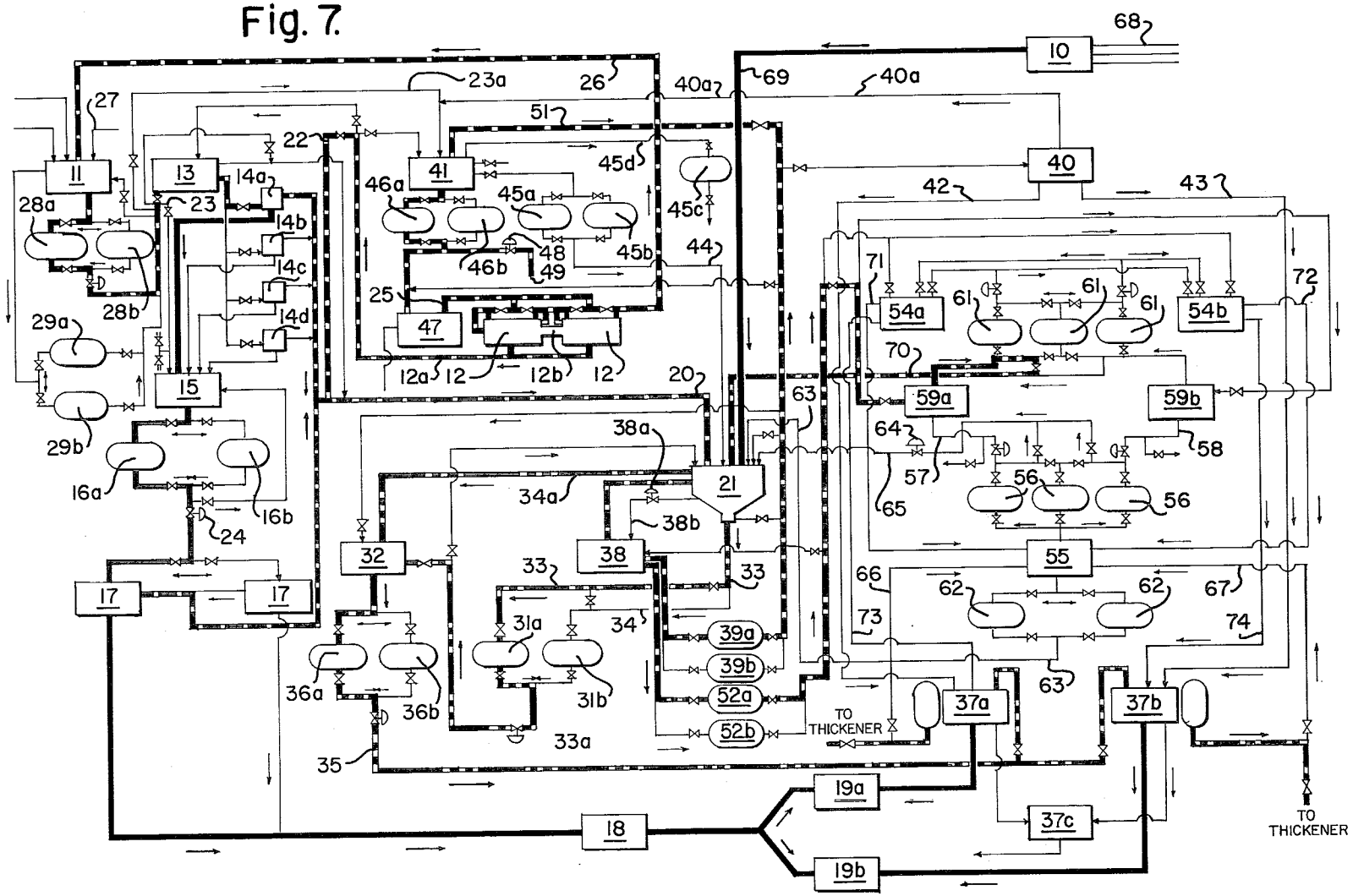

FIG. 2 is a diagrammatic view, showing on reduced scale a modification of the effluent flow scheme shown in FIGS. 1A and 1B, FIG. 3 is a diagrammatic view, showing on reduced scale, a second modification of the flow scheme of FIGS. 1A and 1B, FIG. 4 is a diagrammatic view, showing on reduced scale a third modification of the flow scheme of FIGS. 1A and 1B, FIG. 5 is a diagrammatic view, showing on reduced scale a fourth modification of the flow-scheme of FIGS. 1A and 1B, FIG. 6 is a diagrammatic view, showing on reduced scale a fifth modification of the flow-scheme of FIGS. 1A and 1B, and FIG. 7 is a diagrammatic view, showing on reduced scale a sixth modification of the flow scheme of FIGS. 1A and 1B.

Referring to FIGS. 1A and 1B, the apparatus constituting the system will first be identified and briefly described and then the particular flow scheme for recovery and recycling of coal fines represented therein will be explained.

The apparatus for recovery of coal fines depicted in FIGS. 1A and 1B is associated with the coke-oven charging system in which the pre-heated coal particles are conveyed in a fluidized condition, that is in suspension in a conveying medium such as steam, through headers or pipes extending the length of a coke-oven battery, which may be as much as or more than 1,000 feet in length, and diverted through branch conduits suitably controlled by valves, to the inlet ports of the individual ovens. It will be understood that the individual ovens are usually of the order of 12 to 18 inches in width and up to 40 feet in length. U.S. Pat. No. 3,047,473 to L. D. Schmidt discloses and describes a coke oven charging system in which the coal is preheated and conveyed to the inlet ports of the ovens by wheeled larry cars running on tracks. U.S. Pat. No. 3,537,755 discloses a charging system for coke ovens in which the coal is preheated and conveyed to inlet ports of the ovens in fluidized form via pipe lines employing steam or coke gas as the carrying medium. The apparatus which we employ for recovery of coal fines may also be utilized in connection with coke oven charging systems other than that shown in said patents, such as charging car or conveyor systems.

For simplicity, we have omitted details of the coke oven charging system from the drawings, but will identify the apparatus for recovery of coal fines in particular relation to parts of the coke oven charging system. Thus, for example, there are depicted in the drawings a so-called charge bin vent condenser 10 and a charge line condenser 11. Charge bin vent condenser 10 is a suitably constructed container of a size adequate for the purpose which communicates via suitable conduits with the charge bins of the coke oven charging system and with the hot coal distribution hopper, such as that shown in the patents heretofore mentioned. During the time that the charging bins are connected through branch conduits to the coal conveying headers of the coke oven charging system, the particles of coal evolved incidental to the process and communicated to the charge bin vent condenser may be of the order of +28 mesh consistency. As will be explained more fully later on, the charge bin condenser is one of the sources of coal fines utilized by our invention.

The charge line condenser 11 is a vertically oriented cylindrical casing into which the coal transport lines or headers for the coke ovens are vented and to which the fluidizing steam from coal conveying headers is conducted. Coal fines carried over to the line condenser by the steam bleed line and from tailings from the coal transport line thus constitute a primary source of coal fines to be recovered.

Another source of coal fines recovered by the apparatus is that deposited in the charge main 12. Charge main 12 may comprise one or more parallel large diameter (several feet) pipes which extend coextensively of the length of the coke oven battery and with which the battery of ovens are in communication during the charging operation via a series of goose neck pipe connections. Charge main 12 accumulates coal fines varying from ⅛ inch in diameter down to very small fines of the order of −325 mesh and also some tars distilled out of the gases arising from the coke oven during the charging period.

Spray nozzles (not shown) are provided conventionally in the gooseneck pipe connections and in the charging main between the gooseneck connections for providing the fluidizing liquid for the charge main circuit.

Liquid from the charge main 12 flows by gravity through pitch traps (not shown) located at the discharge of each charge main section and via a line **12*a* to a distribution tank 13 located in the coal preheat structure. From the distribution tank 13 the return path of flow of the liquor is via four 5-foot wide sieve bends 14*a*, 14*b*, 14*c* and 14*d*. A water type gas seal is located in the distributor to maintain pressure in the charge main. These sieve bends are reversible curved screens. The incoming liquor enters at the top and flows down over the top of the sieve. Coarser material which has approximately 25% moisture flows from the top of the four bends into a collecting pump tank 15. Slurry from the tank 15 is pumped by one of several optionally available pumps 16*a*, 16*b* to either one or both of two vibrating de-watering screens 17. Solid material which may contain approximately 15% moisture flows by gravity from the top of the screens to a wet coal distribution hopper 18 whence the wet coal is distributed to a pair of wet coal feed hoppers 19*a* and 19*b*. From the hoppers 19*a* and 19*b*** the wet coal is dropped onto conveyors (not shown) which returns it to one or more of the coal preheaters (not shown) in the oven-charging system.

Underflow from the sieve bends containing liquor and −28 mesh coal flows by gravity from the sieve bends via a line 20 to a central clarifier or thickener 21, hereinafter more fully described.

A by-pass line 22 is provided to by-pass the distribution tank 13 and the sieve bends **14*a*–14*d* to supply material from the charge main circuit directly to line 20 leading to the thickener 21. A make-up line 23 extending from the charge line condenser liquor return line to the pump tank 15 supplies liquid to maintain a pumpable slurry for the material being discharged to the vibrating screens 17. Pump tank 15 is provided with air jets at the bottom of the tank to prevent build up of solids on the bottom of the tank. A flow control valve 24 located in the discharge line from pumps 16*a* and 16*b* is actuated by a level sensor (not shown) in pump tank 15 to open to permit a greater discharge of material from the tank in the event of a rise of level in pump tank 15**.

The charge main circuit also processes the liquor from charge line condenser 11. As previously indicated, charge line condenser 11 is the termination point for three coal transport lines and steam bleed lines for the coal transport lines. Liquor is fed into the line condenser from the charge liquor supply line 25 via a line 26. A portion of the make up water for the apparatus of the coal fines recovery system is supplied to the charge line condenser from a mill water line 27.

Under emergency conditions, the charge line condenser 11 will accept coal which may be contained in the coal transport lines. The line condenser is constructed with a Kreitz tube in the center of the tank constituting the condenser. If coal must be emptied from a coal transport line, it will fill the Kreitz tube and back up into the coal transport line. A water level control is associated with the line condenser so as to maintain a level equal to approximately one-half the height of the condenser. The discharge from the line condenser 11 is effected via one of two pumps **28*a* and 28*b* to a 6 inch line which discharges into the sieve bend distribution tank 13. Any overflow from the line condenser 11 is via a line in which are connected one or both of two parallel-connected pumps 29*a* and 29*b* to the distribution tank 13. A level control (not shown) is actuated responsively to high liquid level in the condenser to initiate operation of the pumps 29*a* and 29*b*. A water seal on the line condenser 11 is designed to maintain a constant level therein to assure flooded suctions to pumps 29*a* and 29*b*. A communication, indicated by the legend "charge line vent", is provided between the line condenser 11 and the charge main 12** to vent the line condenser.

As will be more fully explained later, the thickener 21 clarifies the charge main liquor, liquor from the charge bin vent condenser, and the gas scrubber liquor before returning the clarified liquor to the various circuits. In structure, the thickener is typically a large circular tank, perhaps as large as 100 ft. in diameter with a sheet metal side wall at least 10 feet high and a concrete bottom of shallow inverted cone shape. A rotary rake (not shown) suitably mounted adjacent the bottom of the thickener serves to rake the coarse material (+28 mesh) that sinks to the bottom toward the center. Skimmer devices (not shown) with two fines-collecting boxes are provided at the top of the thickener for collecting the floating material. The coarse material that sinks and is raked to the center of the bottom is pumped by two parallel-connected pumps 31*a* and 31*b* to a fines tank 32. Two discharge pipes 33 and 34 are provided extending from the bottom center discharge port of thickener 21 to the pumps 31*a* and 31*b*. The pipes run from the center of the thickener to the pit of the pumps. Connections are provided in the discharge pipes to admit either high pressure water or steam for cleaning out the discharge pipes.

A density control indicator (not shown) may be provided in the discharge pipes from the bottom of the thickener. Also a density control valve 33*a* is disposed in the pump discharge line to fines tank 32 for restricting flow (to increase density) when density of flow decreases. A communication 34*a* is provided from the top of the thickener for gravity flow of the floating solid material to the fines tank 32.

The accumulation of solids in fines tank 32 is discharged via a communication 35 having optionally one or both of two parallel-connected pumps 36*a* and 36*b*, to two vacuum filters 37*a* and 37*b* from which the solids (+28 mesh) are conveyed to respective wet coal feed hoppers 19*a* and 19*b*. Liquor accumulating in the filters is returned to a sump tank 37*c* from which it flows, as by gravity, to the thickener 21.

Thickener 21 is further provided with a reverse flow launder to receive clarified liquor. The launder is provided with several outlets in order to provide a uniform flow in the launder and to prevent settling out of any possible fine material. The outlets are connected to a clear liquor pump tank 38. Liquor for the charge main circuit is pumped from tank 38 via one of several pumps 39*a* and 39*b* to a charge main flotation cell 40. The flotation cell 40, which is of conventional construction, further clarifies the charging liquor. From the flotation cell 40 liquor flows by gravity via a line 40*a* to a charge liquor pump tank 41. A by-pass line 51 between the intake of the flotation cell 40 and the charge liquor pump tank 41 may be employed, if desired. In such case the flotation cell 40 is cut out of operation. Froth from the flotation cell 40 flows by gravity through lines 42 and 43 respectively to the intake of the vacuum filters 37*a* and 37*b*. Under normal circumstances, the liquid level in thickener 21 is maintained by flow of liquor over weirs into the launder. If the liquor level in the thickener falls, liquor will not flow into the clear liquor pump tank 38, in which the level correspondingly falls. A level sensor (not shown) in tank 38 causes a flow control valve 38*a*, in a by-pass line 38*b* located below the launder, to open to permit flow of excess liquor from the thickener into the clear liquor pump tank. If desired, an alarm may be provided to alert the operator to this condition. Emergency water inlets to the charge main system, located at the charge main are provided, which may be opened under the condition described so as not to starve the charge main.

A line 44 is provided between the charge liquor pump tank 41 and the thickener 21 through which any possible coal fines which may float on the top of the liquor in the pump tank 41 will overflow through line 44 and be pumped by parallel-connected pumps 45*a* and 45*b* into the thickener 21. If desired, pumps 45*a* and 45*b* may also be used to pump liquor from the bottom of the pump tank 41 into the thickener. An additional pump 45*c* is provided in a line 45*d* out of the bottom of pump tank 41 to discharge into the collecting main 49 any tar that may accumulate in the bottom of the tank 41 under standby operating conditions of the coke-oven charging system.

Liquor from the charge liquor pump tank 41 is discharged via a discharge line including one or both of two parallel-connected pumps 46*a* and 46*b* and via a charge liquor strainer 47 to the charge liquor supply line 25. As previously indicated, liquor is also supplied from the supply line 25 via line 26 to the charge line condenser 11. The charge liquor pumps 46*a* and 46*b* are kept operating under standby conditions, and if this condition continues more than 24 hours, the charge liquor may show evidence of liquid tar which is removed via line 45*d*.

A flow control or bleed valve 48, located in the discharge line from the charge liquor pump tank, is provided which in response to high liquid level in tank 41 discharges liquor into the collecting main for gases at 49.

A by-pass line 50 is provided between the charge liquor line 12*a*, from the charge main 12 to the distribution tank 13, and the charge liquor pump tank 41 to permit by-passing the entire sieve bend, vibrating screen system and thickener so that liquor may flow from the charge liquor line 12*a* out of the charge main directly back to the pump tank 41 and thus via the strainer 47 to the charge main 12. As previously stated, a by-pass line 51 is provided to enable clarified liquor to flow from the thickener directly into the charge liquor pump tank 41, in by-pass of the flotation cell 40.

Other apparatus employed for recovery of coal fines comprises the equipment constituting the so-called excess recycle gas scrubber circuit, the source of the coal fines being the secondary cyclone separators (not shown) and the gas scrubber, hereinafter identified. It will be understood that the term excess recycle gas refers to the recycled gas not required in the process of heating wet coal prior to fluidization and conveyance through ductwork to the hot coal distribution hopper. One scrubber is provided for each coal preheat train. By reason of the nature of the material entering the scrubber circuit, the solid material being handled is relatively fine, being of −28 mesh and a percentage of material as fine as −100 mesh.

The scrubber circuit is so designed that the liquor may be clarified (1) through the thickener only (2) through flotation cells only, or (3) through a combination of thickener and flotation cells. The basic flow scheme (3) will now be described so to enable all of the elements of apparatus to be identified. The flow schemes (1) and (2) will be described more fully later on in connection with other Figures of the drawings.

Clarified liquor from the thickener 21 flows into clarified liquor pump tank 38 from which clarified liquor is pumped via one or both of two parallel-connected pumps 39*a* and 39*b* through a line to flotation cell 40. Solids of −28 mesh from the flotation cell 40 flow by gravity to the vacuum filters 37*a* and 37*b*. From the vacuum filters, the solids separated out are communicated to the wet coal feed hoppers 19*a* and 19*b* whence it reenters the coal reheat cycle. The liquor separated out at filters 37*a* and 37*b* is returned to the thickener 21. Also a portion is returned to a scrubber pump tank 55 by gravity via lines 66 and 67. Liquor from the flotation cell 40 flows by gravity through line 40*a* to charge liquor pump tank 41, from which charge liquor is pumped via one or both of pumps 46*a* and 46*b* and strainer 47 to the charge main 12.

From the scrubbers 59*a* and 59*b* the liquor is pumped via one or more of three auxiliary pumps 61 to the scrubber flotation cells 54*a* and 54*b*, whence the liquor is recirculated by gravity to the scrubber pump tank 55, and then via pumps 56 and lines 57 and 58 to the scrubbers. Froth collected in the flotation cells 54*a* and 54*b* flows by gravity via communicating lines to the vaccum filters 37*a* and 37*b*.

Also associated with scrubber pump tank 55 are a plurality of parallel-connected pumps 62, shown as two in number, one or both which may be employed, which pumps cause any possible coal fines floating on the top of the liquor in the scrubber pump tank 55 to be pumped through a line 63 to the thickener.

Also associated with scrubber pump tank 55 is a level control arrangement which actuates a flow control valve 64 located downstream of pumps 56 to increase discharge from the tank 55 to the thickener 21 via a constant bleed line 65, in the event the level in tank 55 rises above normal.

As indicated previously, the charge bin vent condenser 10 constitutes a third expedient for recovery of coal fines. It should be understood that the charge bin vent condenser is in communication with the charge bins through which heated coal is distributed to the coke ovens and also with the hot coal distribution hopper of the coke oven charging system (not shown). After the coke oven charging operation, depressurizing steam flows from the charging bins through conduits to the charge bin vent condenser carrying with it in suspension quantities of −28 mesh particles of coal. At the completion of an oven charging operation, the depressurizing valve on the charge bin that has been in use is opened and the remaining steam, as it is vented into the charge bin vent condenser, carries with it quantities of coal particles. Also, during the filling cycles of the charging bins, gases and particles of coal are carried over into the charge bin vent condenser. Also water developing from condensation of steam collects at the charge bin vent condenser.

Also, as shown, a supply of mill water is delivered to the charge bin vent condenser via a line 68. One or more suitable lines, represented by the single conduit and reference numeral 69, are provided through which the liquor discharged from the charge bin vent condenser flows by gravity to the thickener 21 located at a lower level.

In view of the large number of valves employed for controlling liquor flow, for controlling connection of stand-by pumps, and for effecting different combinations of apparatus or flow schemes in (1) charge main circuit (2) excess recycled gas scrubber circuit and (3) the charge bin vent condenser circuit as hereinafter more fully described, the valves are not specifically identified by reference numeral. However, since the valves are clearly shown in the drawings, it should be apparent how the different flow schemes and stand-by connections are established without identification of the specific valves involved.

The flow of liquor in the apparatus of FIGS. 1A and 1B, comprising the charge main circuit, the charge bin vent condenser circuit and the scrubber circuit, as hereinbefore described, is depicted by codified lines indicating the constituency of the liquor, and by arrows indicating direction of liquor flow. The actual consistency of the liquor in size of particles in each case, is indicated opposite the coded lines in the table in the lower right corner of FIG. 1B. Thus for the two lines labeled "solids" the liquor has coal particles in excess of 28 mesh and less than 28 mesh, respectively. The coded line for the scrubber circuit represents liquor having coal fines varying in size from −28 mesh to −325. The coded line for the charging liquid represents a slurry of fines varying from ⅛ inch diameter to −325 mesh size but averaging −28 mesh size.

In order to initiate operation of the apparatus it is necessary to fill the system parts to appropriate levels with water from various mains (not shown). This is particularly true for the thickener 21 which requires thousands of gallons of water to attain an operating level.

Assuming that the operation of the apparatus of FIGS. 1A and 1B has been initiated the patterns of liquor flow in the several circuits may be readily followed by means of the codified lines. Thus, the flow in the charge main circuit may be traced from the charge main 12 via line 12*a* to the distribution tank 13, whence it flows, as by gravity, over the top of the four sieve bends 14*a*, 14*b*, 14*c* and 14*d*. The liquor of −28 mesh, flows through the sieve bends and thence via return line 20 to the thickener 21. The solids of +28 mesh separated out at the sieve bends flow through suitable lines or conduits from the sieve bends 14*a* to 14*d*, to pump tank 15 whence it is pumped by one or both of the two pumps 16*a* and 16*b* to vibrating dewatering screens. The liquid in the liquor is separated out and returns by a branch line to conduit 20 and then on to the thickener. The solids in the liquor of +28 mesh are returned through a conduit to the wet coal distribution hopper 18, from which it is distributed to the two wet coal hoppers 19*a* and 19*b*. Suitable conveyors, such as of the screw type return the wet coal fines into the coal heating process of the coke oven charging system, thereby recovering the coal fines which would otherwise have been lost or sprayed as pollutants into the atmosphere.

We have found a beneficial result to be produced in addition to and aside from the recovery and recycling of the coal fines. It will be understood that tars, distilled from the pre-heated coal being transported in the oven charging system, are necessarily evolved in the circuit including the charge mains 12 and are absorbed by the coal fines forming part of the liquor circulated therein. We have found that the tars in the coal fines solids returned via the wet coal feed hoppers to the coal preheating phase of the oven charging system functions to facilitate the flow of fluidized coal through pipe lines of the oven charging system, to reduce the carryover of fine coal from the ovens and to increase the bulk density of the preheated coal in the coke ovens. Since utilization of tars for this purpose and in this manner avoids the necessity for providing an oil additive to the fluidized coal in pipe lines of the oven-charging system, our system for recovery of coal fines results in considerable saving in operating costs compared to other recovery systems.

The liquor with coarse fines from top and bottom of the thickener 21 flows by gravity or is propelled by pumps 31*a* and 31*b* to the fines tank 32 whence it is further propelled by one or both of the two pumps 36*a* and 36*b* through a suitable conduit to the vacuum filters 37*a* and 37*b*. The liquor with solids in excess of 28 mesh separated out by the filters 37*a* and 37*b* is returned as by gravity, through suitable lines to the wet coal hoppers 19*a* and 19*b*, whence it is returned to coal heating process of the coke oven charging system. The liquor with solids of −28 mesh separated out by filters 37*a* and 37*b* is returned as by gravity through lines 66 and 67 to the scrubber tank 55, where it enters into the scrubber circuit, as hereinafter described.

Returning to the thickener 21, the clear liquor from the middle level of thickener flows as by gravity to the clear liquor tank 38, whence it is pumped by one or both of pumps 39*a* and 39*b* via a suitable conduit to flotation cell 40 whence the clear liquor is returned, as by gravity, through line 40*a* to the charge liquor tank 41. From tank 41, the charge liquor is pumped by one or both of pumps 46*a* and 46*b* and via charge liquor strainer 47 to the charge liquor supply pipe 25 and back to the charge main 12, thereby completing the charge liquor circuit.

The excess recycled gas scrubber circuit is shown by the codified lines in FIG. 1B, the liquor comprising coal fines varying from −28 mesh to −325 mesh. The flow path of liquor for the scrubber circuit may be traced starting from scrubbers 59*a* and 59*b* via pumps 61 to flotation cells 54*a* and 54*b*, and thence in two streams, one of which comprising liquor and smaller fines goes by corresponding conduits to the scrubber pump tank 55 and the other of which comprising froth, larger fines and solids goes by corresponding conduits 73 and 74 to the vacuum filters 37*a* and 37*b* respectively. A bleed line 65 is tapped off the line 57 leading to the scrubbers whereby excess quantities of liquor built up in the system, with the continued recirculation thereof, may be removed to the thickener 21, to avoid build up of excess levels of liquor in the scrubber pump tank 55. From the vacuum filters the scrubber liquor returns via corresponding conduits 66 and 67 to the scrubber tank 55, the coarser solids or coagulated particles going to the wet coal hoppers 19*a* and 19*b* as before described.

The charge bin vent condenser 10 is also in operation in the flow scheme of FIGS. 1A and 1B as shown by the codified line 69 connecting the condenser 10 to the thickener 21. The liquor flowing, as by gravity, through line 69 to the thickener from the charge bin vent condenser 10 contains solids, usually of −28 mesh size. In the thickener, the solids eventually are gravitated or pumped to the fines tank 32, and thence via one or both of pumps 36*a* and 36*b*, and vacuum filters 37*a* and 37*b* to the wet coal feed hoppers.

The apparatus described is capable of processing the effluent from the heating and charging system for one coke oven battery, which system usually comprises two coal heaters, each operating at 80–100 tons per hour of wet coal.

Under standby conditions, as when oven charging operations are not being carried on, the charge liquor pump circuit should be maintained in operation. If the standby condition continues for more than 24 hours, the charge liquor may show evidences of containing tar. During the standby period, therefore, the charge liquor flow should be diverted to by-pass the sieve bends 14*a* to 14*d*, thickener 21 and charge liquor flotation cell 40 through by-pass line 50 directly back to the charge liquor pump tank 41 as shown in the flow scheme of FIG. 6 later to be described. At the same time, the pump 45*c* should be set in operation to discharge whatever tar may accumulate in the bottom of charge liquor pump tank 41 into the collecting main 49. Conventional apparatus is known for separating tars from gases and vapors flowing in the collecting main.

It will be seen that in the flow scheme of FIGS. 1A and 1B, the charge liquor circuit includes the thickener 21 and optionally, the sieves 14*a* to 14*b* for recovery of fines, whereas the charge bin vent condenser 10 circuit employs the thickener alone. The scrubber circuit in contrast, functions separately from and independently of the thickener.

MODIFIED FLOW SCHEME OF FIG. 2

The flow scheme depicted in FIG. 2 is represented by codified lines corresponding to those employed in the flow scheme of FIGS. 1A and 1B. The apparatus employed in the flow scheme of FIG. 2 is substantially identical to that employed in the flow scheme of FIGS. 1A and 1B and thus no additional description is deemed necessary, corresponding elements being designated by the same reference numerals as in FIGS. 1A and 1B.

The flow scheme of FIG. 2 differs from that of the flow scheme in FIGS. 1A and 1B in that the charge liquor discharge flow from the charge mains 12 via passage 12*a* does not go to the distribution tank 13 but by-passes it and the sieves bends 14*a* to 14*d*, returning directly to the thickener 21 via lines 22 and 20. However, with charge liquor return flow via passage 26 to the charge line condenser 11 remaining unchanged the charge line condenser continues to discharge liquor containing coal fines to the distribution tank 13, whence flow to the sieve bends 14*a* and 14*d* follows as in the flow scheme of FIGS. 1A and 1B.

In view of the fact that the charge main circuit, scrubber circuit and charging bin vent condenser circuit have already been traced in detail, it is deemed unnecessary to repeat the description of these circuits in connection with the modified flow scheme of FIG. 2.

MODIFIED FLOW SCHEME OF FIG. 3

Referring now to FIG. 3, a further modification of the flow scheme of FIGS. 1A and 1B is shown. As in FIG. 2, the apparatus is identified by the same reference numerals as in FIGS. 1A and 1B, without further description.

The flow scheme for this modification differs from that of FIGS. 1A and 1B in that the liquor in the scrubber circuit returns directly to the thickener 21 via a line 70 after discharge from the scrubbers 59*a* and 59*b*. Also, scrubber liquor is supplied to the flotation cells 54*a* and 54*b* from the thickener via the clear liquor pump tank 38, one or both of pumps 52*a* and 52*b*, and pipe line 53, and returns by gravity from the flotation cells to the scrubber pump tank 55 via lines 71 and 72. As in the flow scheme of FIGS. 1A and 1B, the solids separated out in the flotation cells 54*a* and 54*b* are returned via lines 73 and 74 to the vacuum filters. As before described, liquor is restored from the vacuum filters to the scrubber tank 55 and liquor with solids goes to the wet coal feed hoppers 19*a* and 19*b*.

It will thus be seen that the flow scheme of FIG. 3 differs essentially from that of FIGS. 1A and 1B in that the scrubber circuit includes the thickener 21 as well as the scrubber flotation cells 54*a* and 54*b*.

In this flow scheme it is to be observed that, since the liquor from the scrubber circuit entering the thickener is acidic whereas that from the charge liquor circuit is alkaline, the liquor pumped from the thickener is usually neutralized. However, if there is an excess quantity of either acidic or alkaline liquor entering the thickener, a quantity of neutralizing agent may be added into the thickener.

Also where, as in the flow schemes of the preceding FIGS. 1A and 1B, as well as in FIG. 2, the scrubber circuit operates independently of the thickener, it is necessary to add the neutralizing acidic agent to the thickener in order to insure a neutralized liquor being pumped from the thickener.

MODIFIED FLOW SCHEME OF FIG. 4

Referring to FIG. 4, a further modified flow scheme is depicted in codified lines corresponding to the lines in previous flow schemes. In this flow scheme the excess recycled gas scrubber circuit includes only the scrubber flotation cells 54*a* and 54*b* and is independent of the thickener 21. As in the flow scheme of FIGS. 1A and 1B, the flow of liquor in the scrubber circuit may be traced from the scrubbers 59*a* and 59*b* via pumps 61, flotation cells 54*a* and 54*b*, scrubber pump tank 55, and scrubber pumps 56. As in FIGS. 1A and 1B the liquor with heavier solids is conducted, as by gravity, via lines 73 and 74 to the vacuum filters 37*a* and 37*b*.

Another difference in the flow scheme of FIG. 4 and that of FIGS. 1A and 1B, lies in the charge main charge liquor flow which by-passes the sieves 14*a* to 14*d*, as well as the dewatering screens 17, and returns directly to the thickener 21 via line 20.

Another difference in the flow scheme of FIG. 4 and that of FIGS. 1A and 1B lies in the charge line liquor flow through the charge line condenser 11 and thence, in by-pass of the sieve bends 14*a* to 14*d*, directly back to line 20 leading to the thickener.

Thus, it will be seen that in the flow scheme of FIG. 4, the flow of liquor in the scrubber circuit is independent and separate from the thickener, whereas the charge liquor, charge line condenser and charge bin vent condenser flow is via the thickener only. No use is made of sieve bends 14*a* to 14*d* or screens 17.

MODIFIED FLOW SCHEME OF FIG. 5

Referring to FIG. 5, another flow scheme is shown in which the scrubber circuit includes the thickener 21 and the scrubber, while charge and scrubber flotation cells 40, 54*a* and 54*b*, as well as sieve bends 14*a*–14*d* are not used. More specifically, the charge main circuit may be traced from the charge mains 12 via lines 12*a*, 22 and 20 to the thickener 21. From the thickener 21, the return flow may be traced via line 38*b*, clear liquor tank 38, one or both of pumps 39*a* and 39*b*, and back to charge liquor supply line 25 via a by-pass line 76 and strainer 47 to the charge mains 12.

The scrubber liquor flows from the scrubbers 59*a* and 59*b* via a line 70 directly to the thickener 21. The return flow from the thickener may be traced via line 38*b*, clear liquor pump tank 38, one or both of pumps 52*a* and 52*b*, directly to the scrubbers 59*a* and 59*b*, whence the circulation continues as before traced.

The charge liquor flow through the charge line condenser, as in the flow scheme of FIG. 4, may be traced from the supply line 25, via line 26, charge line condenser 11 and thence via pumps 28*a* and 28*b*, distribution tank 13 to line 20 which leads to the thickener.

The flow path for coarse fines from top and bottom of the thickener 21 is the same as in the scheme of FIG. 4, passing via fines tank 32 and pumps 36*a* and 36*b*, to vacuum filters 37*a* and 37*b*, from which the solids are returned to the wet coal feed hoppers 19*a* and 19*b*. The liquor from the vacuum filters is returned directly back to the thickener.

As in all of the preceding flow schemes, the liquor flow from the charge bin vent condenser 10 is directly to the thickener via line 69.

MODIFIED FLOW SCHEME OF FIG. 6

Referring to FIG. 6, another flow scheme is shown in which the charge main circuit flow is self-contained and without the thickener 21, and the scrubber circuit flow is separate and without the thickener, except for bleed line 65. The liquor flow from the charge bin vent condenser 10 is directly to the thickener as in all the previous schemes.

The charge main circuit flow may be traced from the charge mains 12, via line 12*a* to the charge liquor pump tank 41, whence it returns via pumps 46*a* and 46*b* and strainer 47 to the charge main supply pipe 25. The liquor flow through the charge line condenser 11 may be traced from the charge main supply pipe 25, via line 26, charge line condenser, one or both of pumps 28*a* and 28*b* and back to the charge liquor pump tank via line 23*a*. In this flow scheme, tars which may collect in the pump tank 41 are discharged via line 45*d* and pump 45*c* to the collecting main.

The liquor flow in the scrubber circuit may be traced from the scrubbers 59*a* and 59*b*, via pumps 61 to the scrubber flotation cells 54*a* and 54*b*, from which the liquor returns to the scrubber pump tank via lines 71 and 72 and from which the solids are passed on via lines 73 and 74 to the vacuum filters 37*a* and 37*b*.

The flow of coarse fines from top and bottom of the thickener may be traced, as previously, via fines tank 32 and pumps 36*a* and 36*b* to vacuum filters 37*a* and 37*b*, from which the solids are carried on to the wet coal feed hoppers 19*a* and 19*b*.

MODIFIED FLOW SCHEME OF FIG. 7

Referring to FIG. 7, another flow scheme is shown in which the flotation cells 40, 54*a* and 54*b* are not used in any of the flow circuits and all the liquor is treated through the thickener 21.

Considering first the charge main circuit, it will be seen that the liquor flow is directly via line 26 to the charge line condenser 11 from the liquor supply line 25. From the line condenser, a slurry of liquor and solids is withdrawn via one or both of the line condenser pumps 28*a* and 28*b* and discharged to the distribution tank 13 from which the liquor is distributed to the several sieves 14*a* to 14*d* where the solids in excess of 28 mesh are separated out, the liquor continuing on to line 20 leading to the thickener 21. The solids separated out at the sieves pass to pump tank 15, whence the solids (in slurry form) continue on through one or both of pumps 16*a* 16*b* and one or both of the dewatering screens 17 to the wet coal distribution hopper 18 and wet coal feed hoppers 19*a* and 19*b* for return to the heaters. The liquor separated out at the dewatering screens 17 returns via line 20 to the thickener.

From the thickener, the clear liquor flows, as by gravity, to the clear liquor pump tank, whence it is discharged via one or both of charge liquor pumps 39*a* and 39*b* to the charge liquor pump tank 41 via line 51. From the pump tank 41, the liquor is returned to the supply line 25 via strainer 47, and in part, via charge mains 12, lines 12*a*, 22 and 20 to the thickener.

The liquor containing solids from the thickener of −28 mesh flows from top and bottom of the thickener to the fines tank 32, the liquor with coarser fines from the bottom of the thickener flowing via pumps 31*a* and 31*b* to the fines tank 32. From the fines tank 32, the liquor is withdrawn via one or both of the pumps 36*a* and 36*b* and supplied to the vacuum filters 37*a* and 37*b*. The slurry of solids removed at the filters 37*a* and 37*b* flows to the wet coal feed hoppers 19*a* and 19*b* and then is returned to the heaters. The liquor separated out at the filters 37*a* and 37*b* flows directly to the thickener.

Liquor liquor from the clear liquor tank 38 is circulated via one or both of pumps 52*a* and 52*b* directly to the scrubbers 59*a* and 59*b* and thence via line 70 to the thickener 21. It will be seen that circulation is maintained by pumps 52*a* and/or 52*b* and that scrubber pumps 56 and auxiliary scrubber pumps 61 are not utilized in this flow scheme.

As for the liquor charge bin vent condenser 10, the flows directly therefrom to the thickener via line 69.

It will thus be seen that the liquor from all of the circuits is clarified through the thickener 21.

In conclusion, it will be seen that the apparatus which we have provided for recovery of coal fines may be readily modified in a number of different ways to provide different flow schemes adapted to the needs of a particular type or capacity of coke oven charging system. It will be apparent that variations in the apparatus may be made within the terms of the appended claims.

We claim:

1. Apparatus for recovering coal particles and fines evolved incidentally to processes in a coke oven charging system in which the coal is preheated, said apparatus comprising a charge main circuit through which a charge liquor is circulated, an excess recycled gas scrubber circuit through which a scrubber liquor is circulated, a charge bin vent condenser circuit through which a liquor flows, and a thickener included in all of said three circuits by which coarse fines are separated from the liquor and restored to the coal preheating process of the coke oven charging system.

2. Apparatus for recovering coal particles and fines according to claim 1, wherein pumping means restores the liquor from which the coarse fines are separated to one of the said circuits.

3. In apparatus for recovering coal particles and fines evolved incidentally to processes in a coke oven charging system in which the coal is preheated, said apparatus comprising a charge main circuit through which charge liquor is circulated, said charge main circuit including a charge main into which coal particles are carried during coke oven charging and a charge line condenser into which coal particles are carried during coke oven charging, the improvement wherein said charge main circuit comprises a charge liquor pump tank, a pump for pumping charge liquor from said charge liquor pump tank to said charge main and to said charge line condenser, a distribution tank into which charge liquor from said charge main and from said charge line condenser flows, screening means interposed in the out flow from the distribution tank, a thickener to which liquor in the charge main circuit is recirculated and in which coarse fines are separated from said liquor, and means by which solids recovered from said thickener are conveyed to the wet coal phase of the coal heating process in the coke oven charging system.

4. Apparatus for recovering coal particles and fines according to claim 3, further comprising a charge bin vent condenser through which a liquor flows, and conduit means via which liquor flowing through said charge bin vent condenser is conveyed to said thickener.

5. Apparatus for recovering coal particles and fines according to claim 3, wherein said apparatus further includes an excess recycled gas scrubber circuit, said scrubber circuit comprising at least one gas scrubber, a flotation cell, a scrubber tank, a first pumping means for pumping liquor from said scrubber tank to said scrubber, a second pumping means for pumping liquor from said scrubber to said flotation cell, and conduit means via which to return a portion of the liquor from said flotation cell to said scrubber tank.

6. Apparatus for recovering coal particles and fines according to claim 5, wherein said scrubber circuit comprises pumping means for causing flow of liquor from said thickener to said scrubbers, and conduit means by which liquor discharged from said scrubbers is returned back to said thickener.

7. Apparatus for recovering coal particles and fines according to claim 3, wherein conduit means conveys liquor under pressure from said thickener to a liquor supply line for said charge main.

8. Apparatus for recovering coal particles and fines according to claim 3, wherein a second pump forces liquor discharged from said charge line condenser under pressure to said distribution tank, conduit means conveys liquor discharged from said charge main and said distribution tank to said thickener, and wherein there is further provided a flotation cell, a third pump for supplying clarified effluent from said thickener to said flotation cell, and conduit means for conveying clear liquor from said flotation cell to said charge liquor pump tank.

9. Apparatus for recovering coal particles and fines according to claim 5, wherein said apparatus further comprises filter means, wet coal hopper means, additional conduit means via which the remainder of said liquid discharged from said flotation cell is conveyed to said filter means, and further conduit means via which the solids portion of the liquor separated out at said filter means is conveyed to said wet coal feed hopper means and the liquid portion of the liquor separated out at said filter means is conveyed to said thickener.

10. Apparatus for recovering coal particles and fines according to claim 1, wherein said charge main circuit includes a charge main into which coal particles are carried during coke oven charging and having communication with said thickener through which liquor is conveyed thereto, a charge line condenser into which coal particles are carried during coke oven charging, a charge liquor pump tank, a pump for pumping charge liquor from said charge liquor pump tank to said charge main and to said charge line condenser, and a distribution tank into which charge liquor from said charge line condenser flows, and screening means interposed in the out flow from the distribution tank from which liquid separated from the liquor is recirculated to said thickener and from which solids separated from the liquor are recovered and conveyed to the wet coal phase of the coal heating process in the coke oven charging system.

11. Apparatus for recovering coal particles and fines according to claim 3, further including valve means for interrupting flow of charge liquor from said charge main to said distribution tank and establishing communication whereby to cause flow of said charge liquor from said charge main to said thickener.

12. Apparatus for recovering coal particles and fines according to claim 3 further including a second pump tank into which liquor with solids in excess of +28 mesh separated by said screening means flows, pumping means, and dewatering screen means to which the liquor with solids from the said second pump tank is conveyed by said pumping means, conduit means conveying the liquid separated out by said screen means to said thickener, and additional conduit means for conveying the liquor with solids separated out by said screen means to the coal heating phase of the coke oven charging system.

13. Apparatus for recovering coal particles and fines according to claim 3, and further including a charge liquor flotation cell, pumping means for causing flow of charge liquor from said thickener to said flotation cell, and conduit means by which to convey the liquid part of the said charge liquor from said flotation cell to said charge liquor pump tank.

14. Apparatus for recovering coal particles and fines according to claim 5, wherein a bleed line between said first pumping means and said scrubber communicates with said thickener, and valve means in said bleed line controls flow through the bleed line according to the level of liquor in said scrubber.

15. Apparatus for recovering coal particles and fines according to claim 5, and further including filtering means, and conduit means by which to convey liquor with solids separated out by said flotation cell to said filtering means, and means by which to restore solids separated out at said filtering means to the coal preheating phase of the coke oven charging system.

16. Apparatus for recovering coal particles and fines according to claim 10, wherein said scrubber circuit comprises a scrubber, and pumping means for circulating a liquid portion of the liquor separated out in said thickener through said scrubber and back to said thickener.

17. Apparatus for recovering coal particles and fines according to claim 13, and further including a filter means to which the solids separated from the liquor at the said flotation cell are conveyed, and pumping means whereby to convey the coarse fines from top and bottom of said thickener to said filter means, and conduit means for conveying the solids separated from the liquor at said filter means to the wet coal phase of the coal heating process in the coke oven charging system.

18. Apparatus for recovering coal particles and fines evolved incidental to processes in a coke oven charging system, said apparatus comprising a charge main circuit including a charge main from which coal particles are removed by liquor discharged therefrom, a thickener, conduit means via which at least a portion of the liquor discharged from said charge main is conveyed to and deposited in said thickener, a clear liquor pump tank to which the liquor clarified in said thickener is conveyed, at least one flotation cell, a first pumping means for conveying clarified liquor from said clear liquor pump tank to said flotation cell, a scrubber tank to which a clear liquid portion separated from said clarified liquor at said flotation cell is conveyed, a scrubber, and second pumping means for pumping the clarified liquid from said scrubber tank via said scrubber back to said thickener.

19. Apparatus for recovering coal particles and fines evolved incidental to processes in a coke oven charging system, said apparatus comprising a charge main circuit including a charge main from which coal particles are removed by a liquor discharged therefrom, a thickener, conduit means via which at least a portion of the liquor discharged from said charge main is conveyed to and deposited in said thickener, a clear liquor pump tank to which the liquor clarified in said thickener is conveyed, at least one flotation cell, a first pumping means for conveying clarified liquor from said clear liquor pump tank to said flotation cell, a scrubber tank to which a clear liquid portion separated from said clarified liquor at said flotation cell is conveyed, a scrubber, and second pumping means for pumping the clarified liquid from said scrubber tank via said scrubber back to said thickener. a charge flotation cell, and a third pumping means for pumping clarified liquid from said clear liquor pump tank to said charge flotation cell, and conduit means via which the liquid portion of liquor separated out at said charge flotation cell is conveyed back to the supply side of the said charge main.

20. Apparatus for recovering coal particles and fines evolved incidental to processes in a coke oven charging system in which the coal is preheated, said apparatus comprising a charge main circuit through which a charge liquor predominantly alkaline in character is circulated, an excess recycled gas scrubber circuit through which a scrubber liquor predominantly acidic in character is circulated, and a thickener to which at least a portion of the liquor circulated in both the charge main circuit loop and in the gas scrubber circuit loop is conveyed, the one liquor serving as a neutralizer for the other.

21. Apparatus for recovering coal particles and fines evolved incidentally to processes in a coke oven charging system in which coal is preheated, said apparatus comprising a charge liquor circuit including a charge main into which coal particles and fines are carried while an oven charging operation is in process, and from which they are carried in fluidized form by a carrier liquid, a charge line condenser into which coal particles and fines in fluidized form are carried from coal transporting means of the coke oven charging system, a charge liquor pump tank, a first pumping means for supplying liquor from said charge liquor pump tank to said charge main and to said charge line condenser, a first conduit means via which to convey liquor discharged from the charge main to said charge liquor pump tank, and a second pumping means for pumping liquor from said charge line condenser to said charge liquor pump tank.

22. Apparatus for recovering coal particles and fines evolved incidentally to processes in a coke oven charging system according to claim 21, further comprising conduit means connected with said charge liquor pump tank, and a third pumping means for removing via said conduit means tars collecting in said charge liquor pump tank.

23. A method for recovering coal particles and fines evolved incidentally to processes in a coke oven charging system in which coal in a preheated fluidized state is conveyed to coke oven charging ports, which method comprises the steps of:

(a) circulating a charge liquor through a charge liquor circuit including a charge main in which coal particles and fines collect during a coke oven charging operation,
(b) passing the charge liquor discharged from the charge main over a sieve bend to separate liquid from solids,
(c) clarifying the liquid separated out in the preceding step (b) and restoring it to the circulating liquor in the charge liquor circuit,
(d) passing the solids separated out in the preceding step (b) in slurry form through a dewatering screen, and
(e) returning the dewatered solids obtained in the preceding step (d) to the coal pre-heating stage of the coke oven charging system.

24. A method for recovering coal particles and fines according to claim 23, and further comprising the step of providing a sieve bend for use in step (b) of claim 23 which separates out solids of +28 mesh size.

25. A method for recovering coal particles and fines according to claim 23, wherein the clarifying step (c) thereof comprises:

(a) providing a clarifying tank containing a body of liquid wherein separation of solids from liquid deposited therein occurs by settling and rising of solids in said body of liquid, (b) removing clarified liquid from the mid-levels of the tank and passing it to a flotation cell wherein to further separate liquid from solids, (c) returning the liquid separated in the flotation cell to the circulating liquor in the charge liquor circuit, and (d) removing the solids separated out in the clarifying tank and returning them to the coal preheating stage of the coke oven charging system.

26. A method for recovering coal particles and fines according to claim 25, comprising the additional step of returning the solids separated out by the flotation cell in step (b) to the coal preheating stage of the coke oven charging system.

27. A method for recovering coal particles and fines collected in a charge bin vent condenser of a coke oven charging system having a coal preheating stage, which method comprises the steps of:

(a) passing a liquid through the charge bin vent condenser to discharge the coal particles and fines therewith, (b) clarifying the liquor discharged from the charge bin vent condenser in step (a) to separate liquid from solids, and (c) returning solids obtained in step (b) to the coal preheating stage of the coke oven charging system.

28. A method for recovery of coal particles and fines evolved incidentally to processes in a coke oven charging system in which coal in preheated fluidized form is conveyed to coke oven charging ports, which method comprises the steps of:

(a) circulating a carrier liquid through a charge main in which coal fines and particles are collected incidental to a charging operation, (b) circulating a carrier liquid through a scrubber in which coal fines are separated out of excess recycled gas released incidental to preheating coal in fluidized form, and (c) passing a carrier liquid through a charge bin vent condenser in which coal fines and particles are collected incidental to a charging operation, (d) clarifying the several carrier liquids in steps (a), (b) and (c) to separate wet solids from the liquid, and (e) restoring the wet solids obtained from step (d) to the coal preheating stage of the coke oven charging system.

29. A method for recovery of coal particles and fines evolved incidentally to processes in a coke oven charging system in which coal in preheated fluidized form is conveyed to coke oven charging ports, which method comprises the steps of:

(a) circulating a carrier liquid through a charge main in which coal fines and particles are collected incidental to a charging operation, (b) circulating a carrier liquid through a scrubber in which coal fines are separated out of excess recycled gas released incidental to preheating coal in fluidized form, (c) passing a carrier liquid through a charge bin vent condenser in which coal fines and particles are collected incidental to a charging operation, (d) providing a clarifier into which the carrier liquids in steps (a), (b) and (c) are caused to flow to separate solids from liquid, (e) conveying the wet solids separated out in step (d) to the coal preheating stage of the coke oven charging system.

30. A method for recovery of coal particles and fines according to claim 29 comprising the further step of recycling the liquid separated out in step (d) into at least one of the circulating carrier liquids in steps (a), (b) and (c).

31. A method of operating a coal fines recovery system associated with a coke-oven charging apparatus having a coal pre-heating phase, which method comprises the steps of:

(a) providing a circuit for circulation of a liquor including a charge main in which coal fines are evolved and absorb tars distilled from coal in process of being charged into a coke-oven through the coke-oven charging apparatus, and (b) recycling some of the fines having absorbed tars back into a mix of coal particles in the coal preheating phase of the oven-charging apparatus, whereby said tars serve to facilitate flow of fluidized coal in a pipe line of the charging apparatus to reduce fine coal carryover and to increase the coal bulk density in the coke oven.

32. A method for operation of a system for recovery of coal fines and particulates evolved incidental to operation of coke-oven charging apparatus wherein fluidized coal is transported by flow through pipe lines, which method comprises the steps of:

(a) providing a charge main in which coal particles and fines are evolved during a coke oven charging operation, which coal particles and fines absorb tars evolved from the coal being transported.

(b) circulating a liquor through a charge liquor circuit including said charge main whereby to fluidize the coal fines and particles, and (c) separating out of said liquor a proportion of solid fines of predetermined size and recycling such fines into a mix of coal in a pre-heating phase of the oven charging apparatus, whereby the tars absorbed in the recycled fines serve to facilitate flow of fluidized coal through pipe lines of the oven charging apparatus, to reduce fine coal carryover and to increase the coal bulk density in the coke oven.

* * * * *

UNITED STATES PATENT AND TRADEMARK OFFICE

CERTIFICATE OF CORRECTION

PATENT NO. : 4,104,128

DATED : August 1, 1978

INVENTOR(S) : Paul V. Faber, et al.

It is certified that error appears in the above-identified patent and that said Letters Patent are hereby corrected as shown below:

Column 2, line 22, after "consistency" delete the period (.) and insert a comma (,).

Column 7, line 4, "vaccum" should read --vacuum--.

Column 9, line 66, "circuit in" should read --circuit, in--.

Column 10, line 26, "circuits in" should read --circuits, in--.

Column 16, line 3, "ener. a" should read --ener, a--.

Signed and Sealed this

Sixth Day of February 1979

[SEAL]

*Attest:*

RUTH C. MASON
*Attesting Officer*

DONALD W. BANNER
*Commissioner of Patents and Trademarks*